United States Patent [19]

Hashimoto et al.

[11] 4,287,494

[45] Sep. 1, 1981

[54] DISTRIBUTED CONSTANT TYPE FILTER

[75] Inventors: Tadashi Hashimoto, Ichikawa; Katsuya Jindou, Kamagaya, both of Japan

[73] Assignee: TDK Electronics Co., Ltd., Tokyo, Japan

[21] Appl. No.: 141,230

[22] Filed: Apr. 17, 1980

[30] Foreign Application Priority Data

Apr. 27, 1979 [JP] Japan ..... 54-51492

[51] Int. Cl.[3] ..... H01P 1/205; H01P 7/06; H01P 7/04

[52] U.S. Cl. ..... 333/202; 333/222

[58] Field of Search ..... 333/202–203, 333/206–207, 219, 222–235, 245, 132, 134

[56] References Cited

U.S. PATENT DOCUMENTS

| | | | |
|---|---|---|---|
| 3,273,083 | 9/1966 | Rose | 333/227 X |
| 4,059,815 | 11/1977 | Makimoto et al. | 333/202 X |

*Primary Examiner*—Marvin L. Nussbaum

*Attorney, Agent, or Firm*—Allison C. Collard; Thomas M. Galgano

[57] ABSTRACT

A filter operable in a microwave frequency band comprises a conductive closed housing having a bottom wall, an upper wall and side walls between said bottom wall and the upper wall, a plurality of resonators fixed on a straight line on the bottom wall inside of the housing, one end of each resonator being grounded to the bottom wall and the other end of each resonator being free standing, each resonator having at least an elongated center conductor and a dielectric body covering the center conductor at least partially in the longitudinal direction of the center conductor, a pair of connectors mounted at the opposite ends at the side walls for coupling the filter with an external circuit, a pair of loops each connected to the inner conductor of said connector and one end of the loops being grounded to the bottom wall, a pair of confronting conductive disks being provided between the free standing end of each center conductor of a resonator and the upper wall to provide the capacitance between said free standing end and the upper wall, the position of each resonator being slightly adjustable along said straight line within an elongated hole provided on the bottom wall, and the length L of the dielectric body covering the center conductor satisfying $L \leqq \lambda_o/5\sqrt{\epsilon_e}$ where $\lambda_o$ being the wavelength in the free space of the center frequency of the filter and $\epsilon_e$ is the effective dielectric constant of the dielectric body.

3 Claims, 4 Drawing Figures

DISTRIBUTED CONSTANT TYPE FILTER

BACKGROUND OF THE INVENTION

The present invention relates to the improvement of the structure of a filter, which has a plurality of resonators with a center conductor covered by a dielectric body.

It is well known that a conductive line with the length $\lambda/4$ (where $\lambda$ is a wavelength) operates as a resonator when one end of the line is grounded and the other end of the line is left in the air, or free standing. When a plurality of that kind of resonators are positioned and the adjacent resonators are electrically and/or magnetically coupled with each other, a small sized filter can be obtained. That kind of filter is called a distributed constant type filter, or a comb-line type filter. That kind of filter is utilized in particular in the microwave band for the use of a mobile communication.

Also, a filter with a plurality of resonators which has a center conductor covered with a dielectric body has been known. That kind of filter can be smaller in size than that which has no dielectric body covering a center conductor. The shortening ratio $\alpha$ of the wavelength by the dielectric body is $$\alpha = 1/\sqrt{\epsilon_e}$$

where $\epsilon_e$ is the effective dielectric constant which depends upon the structure of a line, the distribution of the electromagnetic field, and that effective dielectric constant is usually smaller than the relative dielectric constant $\epsilon_s$ of the dielectric body itself.

The disadvantage of those prior distributed constant type filter is that the characteristics of a filter cannot be adjusted after the filter is manufactured since those characteristics are defined by the structure and/or the dimension of the filter. Therefore, when there is a small manufacturing error in size of a filter, the characteristics of the filter are not satisfactory.

SUMMARY OF THE INVENTION

It is an object, therefore, of the present invention to overcome the disadvantages and limitations of a prior filter by providing a new and improved filter.

It is also an object of the present invention to provide a filter which is small in size and improves the electrical characteristics.

The above and other objects are attained by a filter having a conductive closed housing having a bottom wall, an upper wall and side walls between said bottom wall and the upper wall, a plurality of resonators fixed in a straight line on the bottom wall inside of the housing, one end of each resonator being grounded to the bottom wall and the other end of each resonator being free standing, each resonator having at least an elongated center conductor and a dielectric body covering the center conductor at least partially in the longitudinal direction of the center conductor, a pair of connectors mounted at the opposite ends at the side walls for coupling the filter with an external circuit, a pair of loops each connected to the inner conductor of said connector and one end of the loops being grounded to the bottom wall, further, a pair of confronting conductive disks being provided between the free standing end of each center conductor of a resonator and the upper wall to provide the capacitance between said free standing end and the upper wall, the position of each resonator being slightly adjustable along said straight line within an elongated hole provided on the bottom wall, and the length L of the dielectric body covering the center conductor satisfying $L \leqq \lambda_o/5\sqrt{\epsilon_e}$ where $\lambda_o$ being the wavelength in the free space of the center frequency of the filter, $\epsilon_e$ being the effective dielectric constant of the dielectric body.

BRIEF DESCRIPTION OF THE DRAWINGS

The foregoing and other objects, features, and attendant advantages of the present invention will be highly understood as the same become better understood by means of the following description and accompanying drawings wherein.

DESCRIPTION OF THE PREFERRED EMBODIMENT

Figure 1:
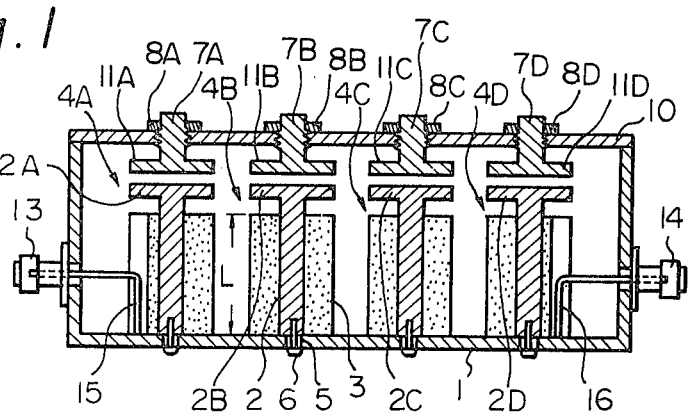
FIG. 1 is the cross sectional view of the embodiment of the filter according to the present invention.
Figure 2:
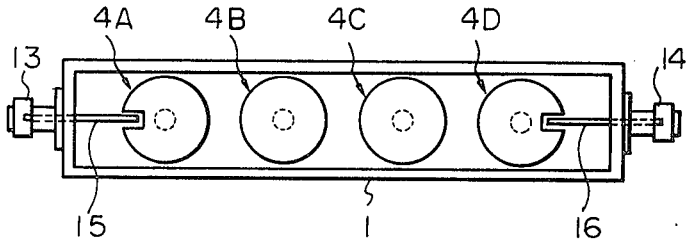
FIG. 2 is the plane view of the present invention, and shows the view that the upper cover is removed.

FIG. 1 is the vertical cross sectional view of the present filter, and FIG. 2 is the plane view of the same when the upper cover is removed. In those figures, the reference numeral 1 is a rectangular conductive housing. In the housing 1, a plurality of resonators 4A, 4B, 4C and 4D are positioned on a straight line on the bottom wall of the housing 1. Each resonator has an elongated center conductor with a circular cross section 2 covered with a hollow circular dielectric body 3, and a circular disk (2A–2D) attached at the open end of the center conductor 2. The length of the center conductor (2A–2D) is actually shorter than $\lambda/4$ because of the presence of the dielectric body. From that structure, it should be noted that one end of each resonator is grounded to the bottom wall of the conductive housing, and the open end which has a disk (2A–2D) is free standing or left in the air.

An elongated or ellipse hole 5 is provided on the bottom wall of the housing 1 for each resonator, and a screw 6 which passes that hole 5 from the outside of the housing 1 fixes the center conductor 2 to the bottom wall firmly. Due to the ellipse hole 5, the position of each resonator is slightly adjustable in the line of the resonators. A dielectric body 3 is either attached to a center conductor 2 by adhesive means before a center conductor 2 is fixed to the bottom wall of the housing 1, or said dielectric body 3 is directly fixed on the bottom wall adhesively. By adjusting the position of each resonator in the corresponding long hole, the manufacturing error of the filter can be compensated.

The housing 1 has a conductive upper cover 10, which has four holes positioned on a linear line, and in those holes a screw (7A–7D) having a conductive disk (11A–11D) each of which confronts with the disk (2A–2D) on the center conductor of each resonator is engaged. The lengths between the disks 11A and 2A of the first resonator 4A, between 11B and 2B of the second resonator 4B, between 11C and 2C of the third resonator 4C, and between 11D and 2D of the fourth resonator 4D are adjustable by rotating the screws 7A through 7D, respectively. Those screws 7A through 7D are locked after adjusting those lengths by lock nuts 8A through 8D. It should be appreciated that the confronting structure by disks between 11A through 11D, and 2A through 2D, respectively, provide capacitance between each pair of disks. The center frequency and/or the characteristics of the filter can be adjusted by controlling the capacitance of those disks.

The pair of side walls of the housing 10 have connectors 13 and 14 for a coaxial cable. The L-shaped loops 15 and 16 are connected to the inner conductors of the connectors 13 and 14, respectively, so that one end of those L-shaped loops are grounded to the bottom wall of the housing 10. Accordingly, it should be appreciated that each of those L-shaped loops is electromagnetically coupled with the extreme end resonators 4A or 4D. It should be appreciated of course that the adjacent resonators 4A and 4B, 4B and 4C, 4C and 4D are electromagnetically coupled with each other.

Figure 3:
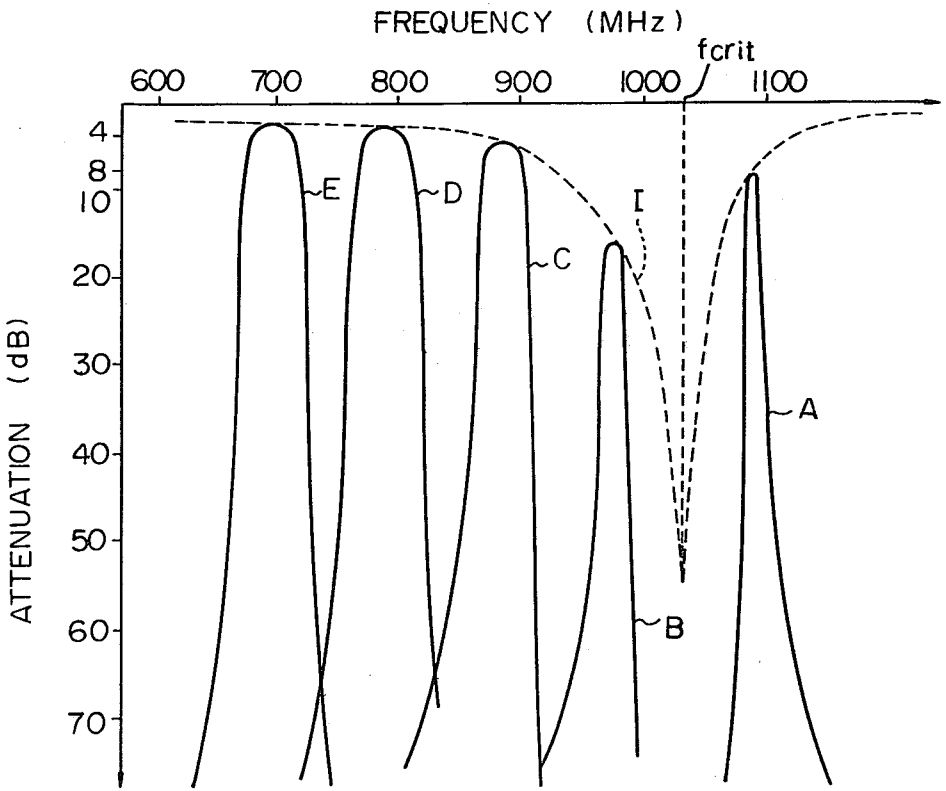
FIG. 3 shows the characteristics of the present filter, in which the attenuation characteristics when the center frequency is controlled are shown.

In the above structure, the center frequency of the filter can be controlled by adjusting the capacitance between the disks 11A, 11B, 11C and 11D, and 2A, 2B, 2C and 2D, respectively by adjusting the screws 7A through 7D, respectively. FIG. 3 shows the attenuation characteristics of the filter of FIG. 1 when the center frequency is controlled by adjusting those capacitances, where vertical axis shows the insertion loss of the filter, and the horizontal axis shows the frequency.

In FIG. 3, when the center frequency of the filter is determined to $f_{crit}$ (=1,040 MHz), the apparatus does not function as a filter since an insertion loss is too large. And the insertion loss of the filter is shown by the dotted line I when the center frequency of the filter is near that frequency $f_{crit}$. The presence of that critical frequency $f_{crit}$ is unknown theoretically, but we presume that the magnetic coupling and the electric coupling between resonators cancel with each other, and there exists no coupling between each resonators at that frequency. The adjustment of the center frequency of the filter is performed by adjusting the capacitance of each resonator by rotating the screws 7A through 7D. When the center frequency of the filter is determined near to that $f_{crit}$, the insertion loss of the filter is rather large, and the attenuation characteristics of the filter is not symmetrical with regard to the center frequency as shown in the curves A and B, where the curve A shows the case that the center frequency is 1090 MHz, and the curve B shows the case that the center frequency is 980 MHz.

When the center frequency of the filter is less than $f_{crit} \times 0.8$, the insertion loss of the filter is small enough for an actual application of the filter to an actual circuit, as shown in the curves C, D and E, where, the center frequencies of the curves C, D and E are 890 MHz, 800 MHz, and 700 MHz, respectively. The insertion loss of the filter is smaller as the center frequency is far apart from the critical frequency $f_{crit}$.

Our experiment shows that when the center frequency is the same as the critical frequency $f_{crit}$, the length L of the dielectric body covering the center conductor 2 satisfies the formula (1)

$$L = \lambda_{crit}/(4\sqrt{\epsilon_e}) \quad (1)$$

where $\lambda_{crit}$ is the wavelength in the free space of the signal of the frequency $f_{crit}$.

Accordingly, if the length L of the dielectric body satisfies the formula (2) taking into consideration said formula (1) and the relationship that the center frequency is less than $f_{crit} \times 0.8$, a desired characteristic of a filter as shown in the curves C, D or E can be obtained by the formula (2), $$L \leqq (\lambda_o/5\sqrt{\epsilon_e}) \quad (2)$$

where $\lambda_o$ is the wavelength in the free space of the signal of the center frequency.

When the center frequency is higher than the critical frequency $f_{crit}$, the size of a filter must be large, but of course that filter is possible if the large size of a filter is not minded.

In a practical design of a filter, the value $\epsilon_e$ which is the effective dielectric constant of the dielectric body must be known. In order to know that value, a prototype filter is manufactured first according to the rough calculation of the resonant frequency and the length L of the dielectric body of each resonator. Then, the critical frequency where the insertion loss of the filter is maximum is measured. Using that measured frequency, the effective dielectric constant $\epsilon_e$ is calculated according to the formula (1).

When the effective dielectric constant is known, the length L covering the center conductor by the dielectric body is determined so as to satisfy the formula (2). According to the actual design thus determined, the filter is produced. The manufacturing error in size of a filter can be compensated by sliding slightly each resonator along a long hole on the bottom wall of the housing. Finally, the center frequency and the characteristics of the filter is adjusted by adjusting the capacitance of each resonator by rotating the screws 7A through 7D. When the desired center frequency and the characteristics are obtained, the capacitance or the screw of each resonator is fixed by locking the nuts 8A through 8D.

Accordingly, it should be appreciated that the presence of the capacitance between a pair of disks on each resonator is the important feature of the present invention.

Figure 4:
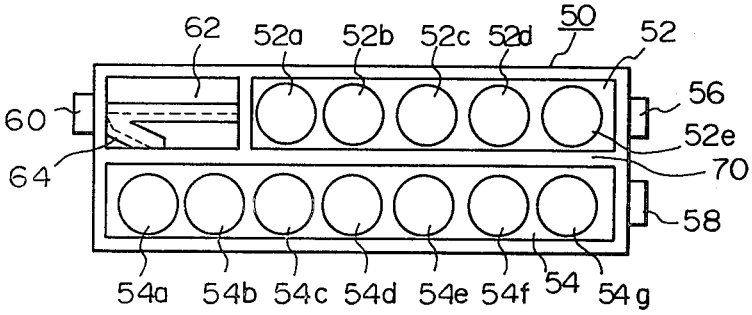
FIG. 4 is the plane view of the application of the present filter, where the upper cover is removed.

FIG. 4 shows the plane view of the application of the present filter, in which an upper cover is removed. The structure of FIG. 4 is the filter for an antenna multiplexer for a mobile communication system. In FIG. 4, the antenna multiplexer 50 has the transmitter filter 52, and the reception filter 54. The former has the resonators **52*a*, 52*b*, 52*c*, 52*d* and 52*e*, the connector terminal 56 which is connected to a transmitter circuit, and the connector terminal 60 which is connected to an antenna. The terminal 60 is connected to the resonator 52*a* which is positioned at the extreme end with the coaxial cable 62. The latter filter 54 has the resonators 54*a*, 54*b*, 54*c*, 54*d*, 54*e*, 54*f* and 54*g* and the connector terminal 58 which is connected to a receiver circuit. The resonator 54*a* which is positioned at the extreme end is connected to the connector terminal 60 through the coaxial cable 64. Both the filters 52 and 54 are mounted in a conductive housing, which has a conductive center wall 70 for the shield between the two filters. The operation of each of filters 52 and 54 is the same as that of the filter in FIG. 1, and two filters are mounted in a single housing, the filter in FIG. 4** is convenient for the use of an antenna multiplexer for a mobile communication system.

As described above in detail, the present filter has resonators covered with dielectric body by the length L defined by the formula (2), and said resonators having a capacitor at the open end of the center conductor. Thus, a filter with small size and the excellent characteristics can be obtained.

From the foregoing it will now be apparent that a new and improved filter has been found. It should be understood of course that the embodiment disclosed is merely illustrative and is not intended to limit the scope of the invention. Reference should be made to the appended claims, therefore, rather than the specification as indicating the scope of the invention.

What is claimed is:

1. A filter comprising a conductive closed housing having a bottom wall, an upper wall, and side walls between said bottom wall and the upper wall, a plurality of resonators fixed on a straight line on the bottom wall inside of the housing, one end of each resonator being grounded to the bottom wall and the other end of each resonator being free standing, each resonator having at least an elongated center conductor and a dielectric body covering the center conductor at least partially in the longitudinal direction of the center conductor, a pair of connectors mounted at the opposite ends at the side walls for coupling the filter with an external circuit, a pair of loops each connected to the inner conductor of said connector and one end of the loops being grounded to the bottom wall, characterized in that a pair of confronting conductive disks is provided between the free standing end of a each center conductor of a resonator and the upper wall to provide the capacitance between said free standing end and the upper wall, and the length L of the dielectric body covering the center conductor satisfies;

$$L \leqq \lambda_o / 5\sqrt{\epsilon_e}$$

where $\lambda_o$ is the wavelength in the free space of the center frequency of the filter, and $\epsilon_e$ is the effective dielectric constant of the dielectric body.

2. A filter according to claim 1, wherein one of each pair of said disks has a screw engaged with the upper wall to adjust the length between the confronting disks, and a lock nut for locking the screw to the upper wall after adjusting said length.

3. A filter according to claim 1, wherein the center frequency of the filter is determined below the critical frequency $f_{crit}$, where the insertion loss of the filter is maximum.

* * * * *